United States Patent [19]

Wright

[11] 4,184,615

[45] Jan. 22, 1980

[54] FOAM DISPENSING DEVICE

[76] Inventor: Hershel E. Wright, P.O. Box 51, Decatur, Ill. 62525

[21] Appl. No.: 786,087

[22] Filed: Apr. 11, 1977

Related U.S. Application Data

[63] Continuation-in-part of Ser. No. 656,347, Feb. 9, 1976, Pat. No. 4,018,364, which is a continuation-in-part of Ser. No. 564,700, Apr. 3, 1975, Pat. No. 4,022,351, and Ser. No. 564,701, Apr. 3, 1975, Pat. No. 3,937,364.

[51] Int. Cl.[2] ..... B65D 37/00

[52] U.S. Cl. ..... 222/190; 222/212; 239/343

[58] Field of Search ..... 222/189, 190, 211-213; 239/343, 327

[56] References Cited

U.S. PATENT DOCUMENTS

| | | | |
|---|---|---|---|
| 3,308,993 | 3/1967 | Bruno | 239/343 X |
| 3,973,701 | 8/1976 | Gardner | 222/190 |
| 3,985,271 | 10/1976 | Gardner | 222/190 |
| 4,044,923 | 8/1977 | Gardner | 222/211 X |

*Primary Examiner*—Charles A. Marmor
*Attorney, Agent, or Firm*—Cohn, Powell & Hind

[57] ABSTRACT

This foam dispensing device includes a flexible container for foamable liquid having a discharge opening at one end. The container is provided with a foam producing assembly which includes a passage leading to the discharge opening and at least one porous member mounted in the passage and having a foam discharging area greater than the cross-sectional area of the passage at the mounting location.

7 Claims, 4 Drawing Figures

FOAM DISPENSING DEVICE

RELATED U.S. APPLICATION DATA

This application is a Continuation-In-Part of Ser. No. 656,347, Feb. 9, 1976 now U.S. Pat. No. 4,018,364, which is a Continuation-In-Part of Ser. No. 564,700, Apr. 3, 1975 now U.S. Pat. No. 4,022,351 and Ser. No. 564,701, Apr. 3, 1975, now U.S. Pat. No. 3,937,364.

BACKGROUND OF THE INVENTION

This invention relates generally to manually compressible foam dispensers and particularly to dispensers having a foam producing assembly utilizing at least one rigid porous member.

The production of foam from manually compressible, flexible containers containing liquid and air, which are mixed prior to discharge, is well-known. Such foam dispensers provide an alternative to the rigid type of foam producing containers, generally known as Aerosol dispensers, and offer the advantages of low cost as well as being ecologically acceptable. Flexible cntainer foam dispensers of this general type are disclosed in the patents issued to Stossel, U.S. Pat. No. 3,010,613; and A. L. Boehm et al, U.S. Pat. No. 3,422,993. Flexible container dispensers are also disclosed in U.S. Pat. Nos. 3,428,422; 3,709,437, 3,937,364 4,018,364 and 4,022,351 said patents being owned by the present inventor. The latter three references are particularly significant because they do disclose foam dispensers which utilize a rigid porous member in the foam producing process.

In general, it has been found necessary in prior foam dispensers to provide a homogenizing element to intermix the liquids and air. This element has commonly taken the form of a screen of metal, cloth or plastic and serves the purpose of condensing large bubbles or intermixing liquid and air to form fine bubbles, ie foam. Most foam devices which utilize a flexible, deformable container must discharge the foam through a discharge passage of limited cross sectional area and, in practice, a large porosity screen has been sed to minimize back pressure caused when the air and liquid is forced through it. Unfortunately, this creates large bubbles, which are undesirable. On the other hand, placing membranes of fine porosity across the discharge passage, while producing superior foam, creates excessive back pressure. This has been the experience with foam dispensers of the type disclosed in U.S. Pat. No. 3,709,437.

One of the problems in producing an acceptable foam in a foam dispenser utilizing a porous member of the type disclosed in U.S. Pat. No. 3,937,364 resides in the fact that the quality of the foam is related to the porosity of the porous member. Although porous members having the necessary small pore structure to produce effective foam are available, reduction of pore size tends to be accompanied by an undesirable increase in the pressure necessary to move the foam through the porous member.

The present invention solves this problem in a manner neither disclosed or suggested in the known prior art.

SUMMARY OF THE INVENTION

This foam dispensing device produces foam from a foamable liquid and air by utilizing a hand pressurized flexible container and a foam producing means mounted in the container which includes at least one porous member.

The foam producing means includes at least one porous member mounted ahead of the discharge port and having a foam discharging surface area of a size and configuration to decrease the back pressure the extent necessary yet provide a high quality foam.

The foam producing means in one embodiment includes a primary foam producing stage and a secondary foam producing stage, at least the secondary foam producing stage including a porous member having a foam discharge surface area greater than the minimum cross-sectional area of the passage ahead of the mounting location of the porous member.

The foam producing means in another embodiment includes a primary foam producing stage and the secondary foam producing stage, each of which includes a porous member having a foam discharge surface area greater than the minimum cross-sectional area of the passage ahead of the mounting location of the respective porous members.

The porous member includes a mounting portion engageable with the passage walls and a foam discharge portion spaced from the passage walls. In one embodiment the porous member is substantially hollow and includes a foam discharge portion spaced from the passage walls and having a substantially conical configuration.

This foam dispenser, which is simple to use and easily manufactured, provides a particularly effective and inexpensive means of dispensing a high quality foam without need for a high pressure container.

DESCRIPTION OF THE PREFERRED EMBODIMENT

Figure 1:
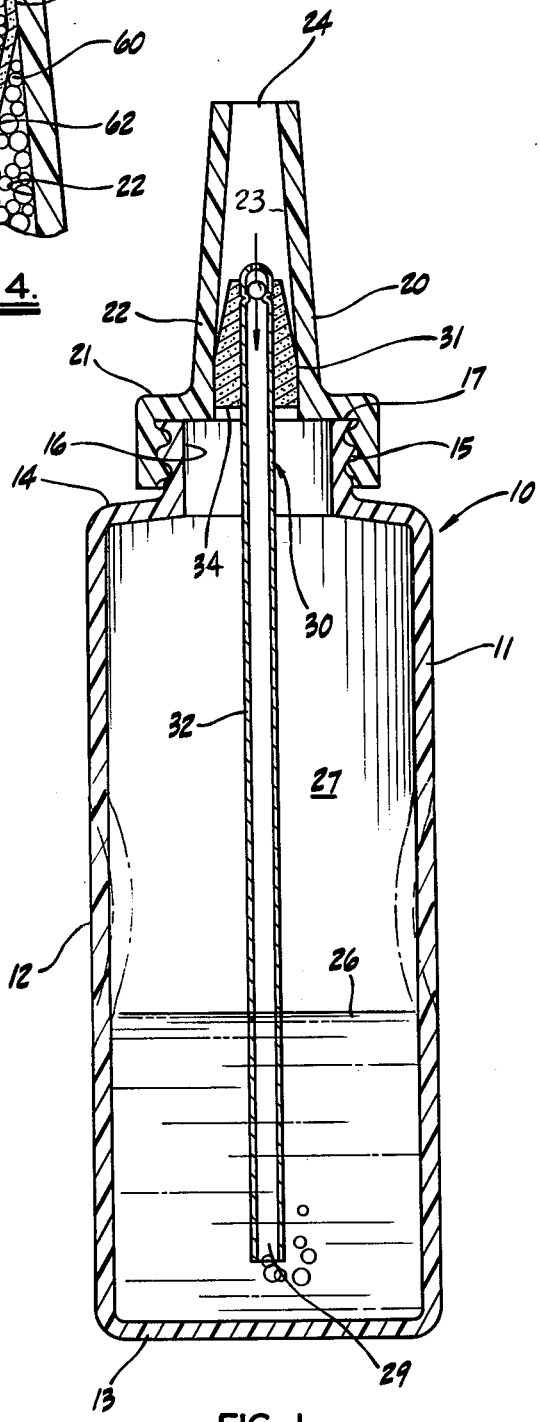
FIG. 1 is a longitudinal sectional view through the flexible container illustrating the improved foam producing assembly.

Referring now by reference numerals to the drawing and first to FIG. 1 it will be understood that the foam dispensing device is generally indicated by numeral 10 and includes a flexible container 11, of plastic or similar material, having a sidewall portion 12, a lower end wall 13 and an upper end wall 14 which is formed into a threaded neck 15 providing an opening 16 defined by an annular end 17. A cap member 20 is provided which includes a base portion 21, compatibly threaded for attachment to the container neck 15, and an upwardly extending spout portion 22 defining a passage 23 terminating in an open end 24 which constitutes a discharge port for the foam. The foam is produced from foamable liquid 26 and air 27 within the container 11 by manually squeezing the container sidewall 12 as indicated in phantom outline. The foam producing means is provided by an assembly housed within the dispenser and generally indicated by numeral 30 and will now be described.

Figure 2:
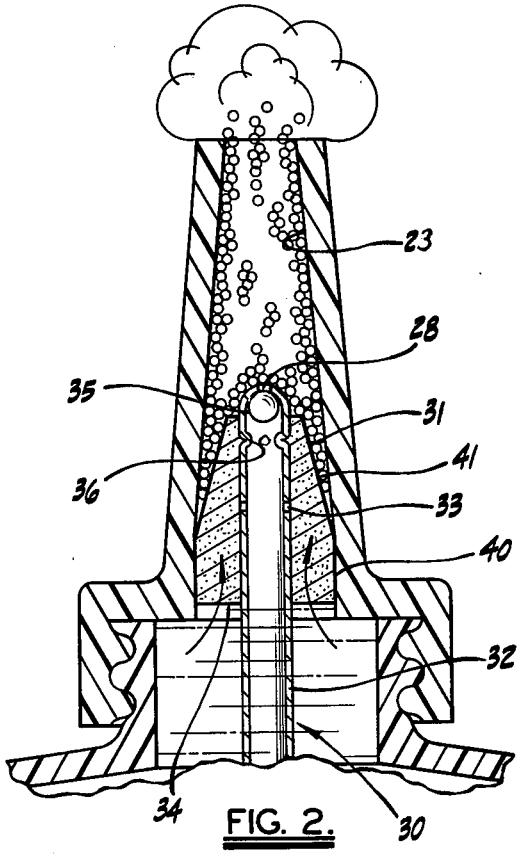
FIG. 2 is an enlarged fragmentary sectional view of the foam producing assembly of FIG. 1.

The foam producing assembly 30 in the embodiment shown in FIGS. 1 and 2 consists essentially of a porous member 31 of rigid material and a depending, substantially non-porous tubular member 32. As clearly shown in FIG. 2, the tubular member 32 includes side openings 33 through which one of the foaming elements enters the porous member 31 while the other foaming element enters the porous member from the inner face 34 of the porous member. It will be understood that with the container 11 in the upright position shown, the liquid 26 is routed into the tubular member 32 by way of lower end opening 29 and through the side openings 33. Whn the container 11 is in the inverted position, on the other hand, air is routed into the tubular member and through the side openings 33. The tubular member 32 includes an outer end opening 28 which is closable by a ball check 35 supported on spaced projections 36. When the container is compressed the opening 28 is closed by the ball check 35 thereby directing the flow of fluid through the side openings 33. The ball check 35 moves away from the opening 34 when the pressure is released and thereby facilitates air re-entry into the container.

Importantly, as shown in FIG. 2, the porous member 31 includes a mounting portion 40, and an outer portion 41. The mounting portion 40 is engageable with the sides of the passage 23 and held in said passage, as by friction. Importantly, the outer portion 41 has a foam discharging surface area greater than the cross-sectional member of the porous member in the vicinity of the mounting portion 40. In the embodiment shown in FIG. 2 this increased area is achieved by providing an outer portion 41 of a frusto-conical configuration which has an angle of slope greater than the inclined face of the passage 23. The result of this configuration is that the exposed surface area of discharge of the porous member 31 provides less resistance to the passage of the foam through the surface of the porous member outer portion 40 so that the pressure required to force the foam through the porous member is less than it would be if the surface area were equal to the cross-sectional area of the passage. This provision of additional surface area is particularly desirable at this location because the resistance of the foam increases as it is formed and moves outwardly.

Figure 3:
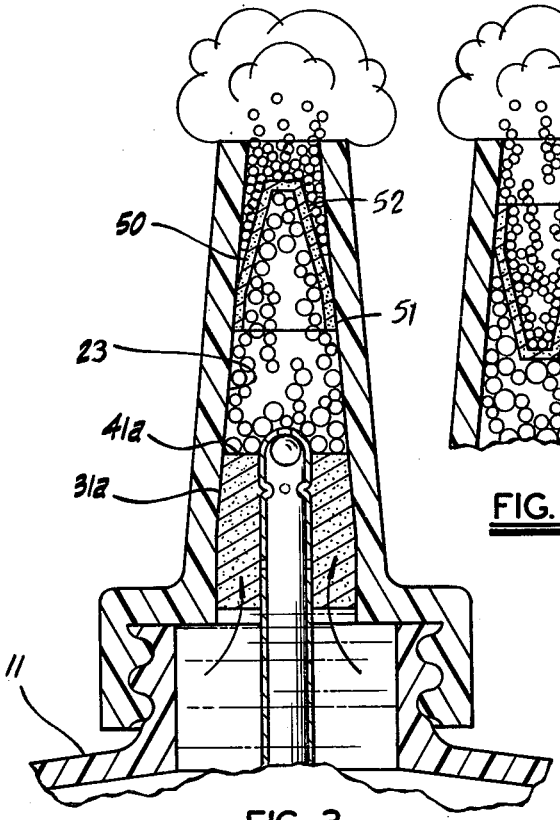
FIG. 3 is an enlarged fragmentary sectional view of the modified foam producing assembly.
Figure 4:
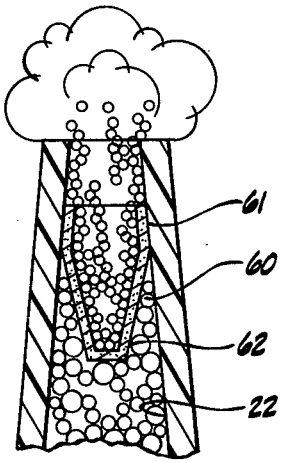
FIG. 4 is an enlarged fragmentary sectional view of another modified assembly.

FIG. 3 illustrates a modified device having a two-stage foam producing assembly. The container 11 and the cap 20 are identical to those disclosed in FIG. 1. The first stage of the foam producing assembly is similar to that disclosed in FIG. 1 and differs from it in that the porous member, indicated by numeral 31*a*, is fitted within the passage 23 and has a configuration providing an exposed area at the outer end 41*a* substantially equal to the cross-sectional area of the passage 23. To this extent the first stage is similar to that provided by the foam dispensing device disclosed in U.S. Pat. No. 3,937,364. The secnd stage of the foam producing assembly is provided by a rigid porous member 50. As shown in FIG. 3 this porous member is generally hollow and includes a mounting portion 51 and an outer portion 52 having a frusto-conical configuration. The outer portion 52 has an exposed area greater than the cross-sectional area of the passage 23 in the vicinity of the porous member mounting portion 51. This configuration provides that the exposed surface area of discharge of the porous member 50 provides less resistance to the passage of foam through said porous member than would be the case if said member were of a circular disc configuration having the same pore size. The result of providing a great discharge area is that there is less resistance to movement of the foam through the second stage. Thus, a superior foam, having smaller bubbles, is produced without significant increase in the pressure which must be applied. The modified two-stage foam producing assembly shown in FIG. 4 is substantially similar to that shown in FIG. 3 except that second stage porous member 60 is inverted so that the locations of the mounting portion 61 and the frusto-conical portion 62 are reversed. In other respects the dispenser can be identical to that shown in FIG. 3. The second stage hollow porous member 60, though inverted, exhibits little loss of effectiveness because the exposed surface area of discharge of the foam is still greater than the cross-sectional area of the passage through which the foam is passing in the vicinity of the mounting portion 61.

Importantly, the second stage porous members 50 and 60 are not limited to use with the first stage formed from another porous member but can be used to improve the performance and foam quality of other types of foam dispenser. For example, either of these porous members can be used with a dispenser of the kind having a mixing chamber type of foam producing means such as that disclosed in U.S. Pat. No. 3,709,437. In addition, the second stage porous members 50 and 60 can also be used in conjunction with a first stage porous member which is of the configuration of the porous member shown in FIG. 2, thereby providing further improvement in the foaming operation.

In the preferred embodiment the porous members are formed from foraminous volcanic glass material; sintered glass, of the type used in filters; or non-compressible plastics such as porous polyethylene, polypropylene, nylon, rayon and the like. Such materials can be manufactured to have a porosity which allows limited air flow therethrough and are, in the preferred embodiments, of the type that is composed of solid miniature spheres connected at their outermost surfaces so as to create voids which permit the sphere size and hence the pore size, to be controlled to produce a selected air resistance.

I claim as my invention:

1. A foam dispensing device comprising:

(a) a flexible container for holding a foamable liquid and air having a discharge port, (b) foam producing means separating the area adjacent said discharge port and the interior of the container including:

(1) passage means from the interior of the container leading to the discharge port, said passage means having a cross sectional area smaller than the container, (2) at least one porous member mounted in the passage means, the porous member having a foam discharging surface area greater than the minimum cross-sectional area of the passage means at the mounting location.

2. A foam dispensing device as defined in claim 1, in which:

(c) the foam producing means includes a primary foam producing stage and a secondary foam producing stage, at least said secondary foam producing stage including said porous member.

3. A foam dispensing device as defined in claim 1, in which:

(c) the foam producing means includes a primary foam producing stage and a secondary foam producing stage disposed outwardly of said primary foam producing stage, each of said foam producing stages including a porous member having a foam discharge surface area greater than the minimum cross-sectional area of the passage means at the mounting location.

4. A foam dispensing device as defined in claim 1, in which:

(c) the porous member includes a mounting portion engageable with the sides of the passage and a foam discharge portion spaced from the sides of the passage.

5. A foam dispensing device as defined in claim 2, in which:

(d) the porous member is hollow and includes a mounting portion engageable with the sides of the passage and a foam discharge portion spaced from the sides of the passage.

6. A foam dispensing device as defined in claim 5, in which:

(d) the hollow porous member foam discharge portion has a substantially conical configuration.

7. A foam dispensing device comprising:

(a) a flexible container for holding a foamable liquid and air having a discharge port, (b) foam producing means separating the area adjacent said discharge port and the interior of the container including:

(1) passage means leading to the discharge port, (2) a primary foam producing stage and a secondary foam producing stage disposed outwardly of the primary foam producing stage, said secondary foam producing stage including a stationary porous member mounted in the passage means, the porous member having a foam discharging surface area greater than the minimum cross-sectional area of the passage means at the fixed mounting location.

* * * * *